US008539874B1

(12) United States Patent
Grove et al.

(10) Patent No.: US 8,539,874 B1
(45) Date of Patent: Sep. 24, 2013

(54) MILITARY VEHICLE WINDOW COVER

(75) Inventors: Lee A. Grove, Mishawaka, IN (US); Donald F. Rhoad, Bamberg, SC (US)

(73) Assignee: Defense Consulting Services, Inc., Bamberg, SC (US)

( * ) Notice: Subject to any disclaimer, the term of this patent is extended or adjusted under 35 U.S.C. 154(b) by 48 days.

(21) Appl. No.: 13/416,045

(22) Filed: Mar. 9, 2012

Related U.S. Application Data

(60) Provisional application No. 61/452,431, filed on Mar. 14, 2011.

(51) Int. Cl.
*F41H 7/02* (2006.01)

(52) U.S. Cl.
USPC ..... 89/36.08; 89/36.01; 89/36.09

(58) Field of Classification Search
USPC .. 89/36.01, 36.04, 36.07–36.09, 36.11–36.14
See application file for complete search history.

(56) References Cited

U.S. PATENT DOCUMENTS

| | | | | |
|---|---|---|---|---|
| 3,672,607 | A * | 6/1972 | Stauff et al. | 244/3.16 |
| 3,966,298 | A * | 6/1976 | Chapman | 359/401 |
| 4,005,662 | A * | 2/1977 | Kohn et al. | 109/16 |
| 4,284,326 | A * | 8/1981 | Durrer et al. | 359/405 |
| 4,326,445 | A | 4/1982 | Bemiss | |
| 4,646,616 | A * | 3/1987 | Svensson | 89/36.14 |
| 4,934,246 | A * | 6/1990 | Benson et al. | 89/36.14 |
| 5,128,803 | A * | 7/1992 | Sprafke | 359/403 |
| 5,452,641 | A | 9/1995 | Kariya | |
| 5,815,302 | A * | 9/1998 | Mc Vey et al. | 359/214.1 |
| 6,122,100 | A * | 9/2000 | Miller | 359/402 |
| 7,225,718 | B1 * | 6/2007 | Grove et al. | 89/36.09 |
| 7,821,706 | B2 * | 10/2010 | Bellandi et al. | 359/402 |
| 8,037,802 | B2 * | 10/2011 | Ciriscioli et al. | 89/36.01 |
| 8,056,463 | B2 * | 11/2011 | Grove et al. | 89/36.09 |
| 8,141,472 | B1 * | 3/2012 | Grove et al. | 89/36.09 |
| 2009/0044694 | A1 * | 2/2009 | Allor et al. | 89/36.08 |
| 2011/0209606 | A1 * | 9/2011 | Grove et al. | 89/36.08 |
| 2012/0204711 | A1 * | 8/2012 | Engleman et al. | 89/36.02 |

* cited by examiner

*Primary Examiner* — Michelle Clement
(74) *Attorney, Agent, or Firm* — Botkin & Hall, LLP

(57) ABSTRACT

A window cover for a vehicle that has an aperture located in place of a window. The window cover has upper and lower reflectors that are pivotally movable with respect to the window cover. The upper reflector is beneath an upper armored plate and the lower reflector is behind a lower armored plate. The reflectors are pivotally linked together. Slats are placed between the upper and lower reflectors that block a trajectory of a projectile from entering a window aperture over which the window cover protects. The slats are placed so as to be as optically thin as possible, meaning the edge thickness is all that will be seen across the reflectors.

13 Claims, 10 Drawing Sheets

MILITARY VEHICLE WINDOW COVER

CROSS REFERENCE TO RELATED APPLICATIONS

This application claims the benefit of U.S. Provisional Application No. 61/452,431, filed Mar. 14, 2011, the disclosure of which is hereby incorporated by reference.

BACKGROUND OF THE INVENTION

The present invention is particularly useful to military vehicles and is a window cover to protect an occupant of the vehicle from being struck by bullets and allow excellent visibility of objects outside the vehicle.

Bullet proof or bullet resistant glass offers some improvement over ordinary glass in combat zones, but even bullet proof glass has its limitations. Typical bullet proof windows are multi-layered assemblies of plastic and glass held in place by a single welded frame that adds hundreds of excess pounds to a vehicle. This type of window also has a high cost of replacement when damaged. Frequently, a single bullet can strike a window and cause tempered glass to fracture into many hairline cracks, or spider cracks that render the window useless.

A particularly useful invention to solve some of the aforementioned problems is disclosed in U.S. Pat. No. 7,225,718. The device has mirrors that may receive projectiles and the driver views objects outside of the vehicle through the mirrors. The mirror that is exposed to the exterior of the vehicle may receive a bullet and have a small hole the size of the bullet upon being penetrated. This invention does not provide adjustment of the view from inside the vehicle.

SUMMARY OF THE INVENTION

The present invention is a window cover for a vehicle that has an aperture located in place of a window. The cover has an upper armored plate having a top side, an underside, a forward end and a rearward end. The forward end of the upper armored plate is farther from the window aperture relative to the rearward end. The underside, at least partially, extends beyond an upper edge of the viewing aperture. An upper reflector is beneath the underside of the upper armored plate and is pivotable with respect to the viewing aperture and the upper reflector is pivotable with respect to the upper armored plate. The upper reflector has a forward end and a rearward end. The forward end of the upper reflector is farther from the window aperture relative to the rearward end of the upper reflector. A lower armored plate is spaced below the upper armored plate and positioned in front of the viewing aperture. The lower armored plate is for stopping or deflecting a projectile that is directed toward the window cover. A lower reflector has a forward end and a rearward end. The forward end of the lower reflector is further from the window aperture relative to the rearward end of the lower reflector. The forward end of the lower reflector is higher than the rearward end of the lower reflector. The lower reflector is pivotable with respect to the viewing aperture and the armored plate. The lower reflector is positioned beneath the upper reflector.

DETAILED DESCRIPTION OF INVENTION

Figure 1:
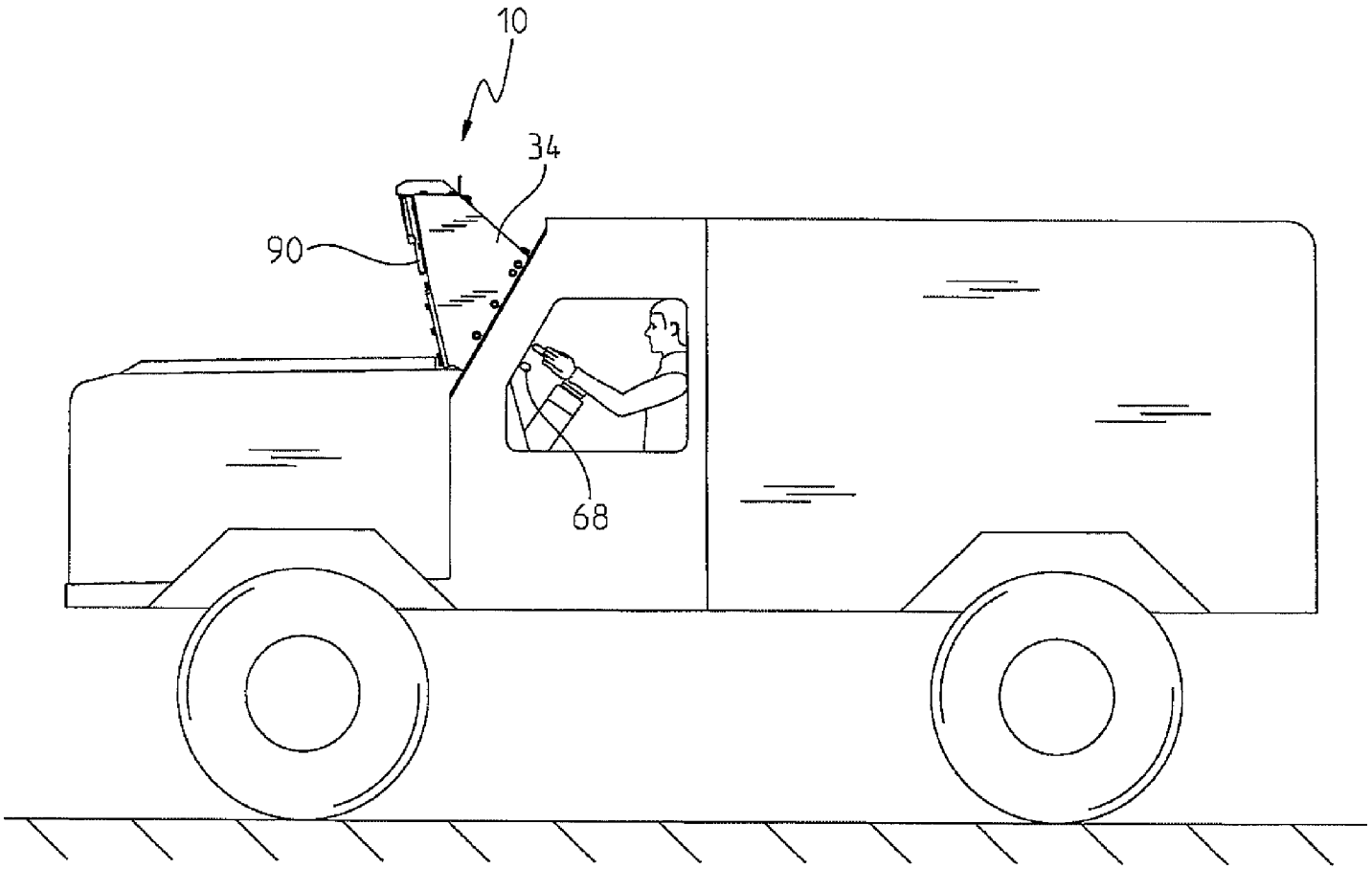
FIG. 1 is a side view of a vehicle having the window cover installed on a front window of the vehicle.
Figure 2:
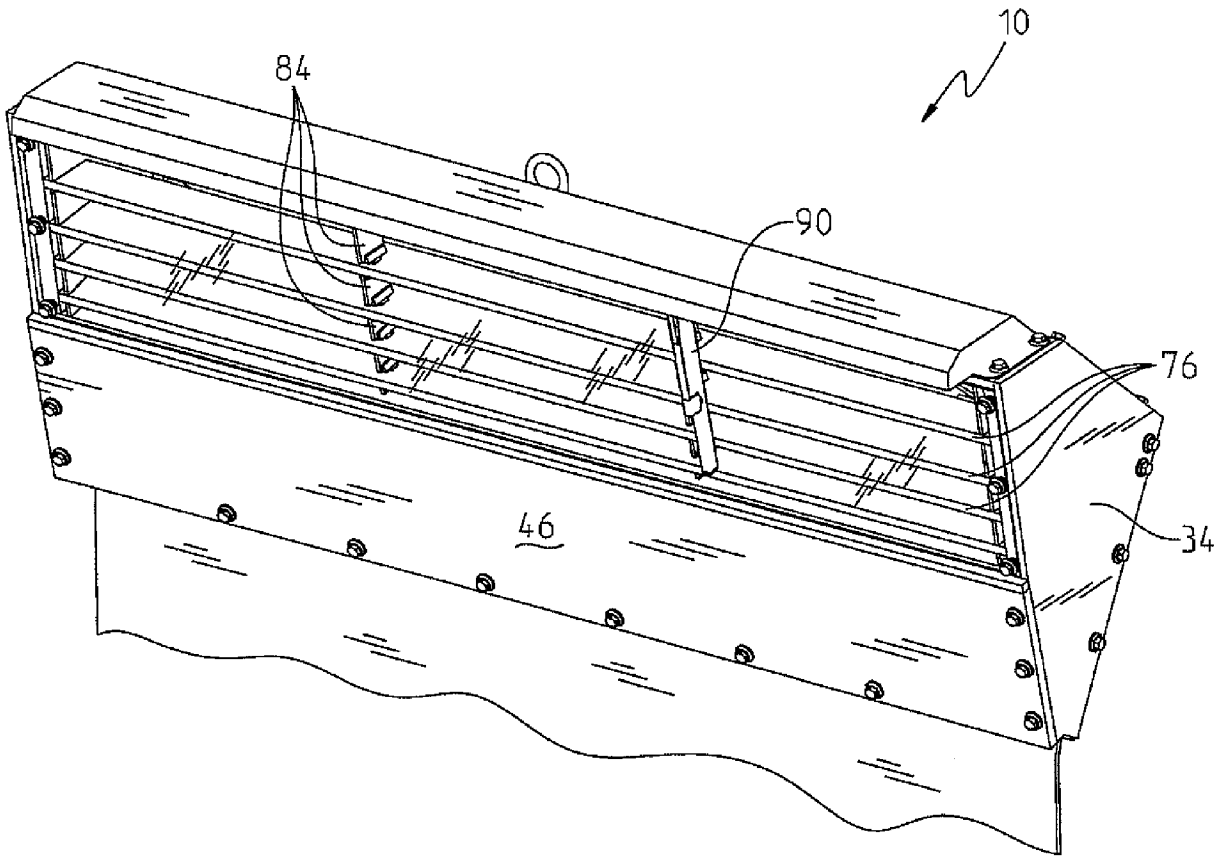
FIG. 2 is a perspective view of the window cover of FIG. 1.
Figure 3:
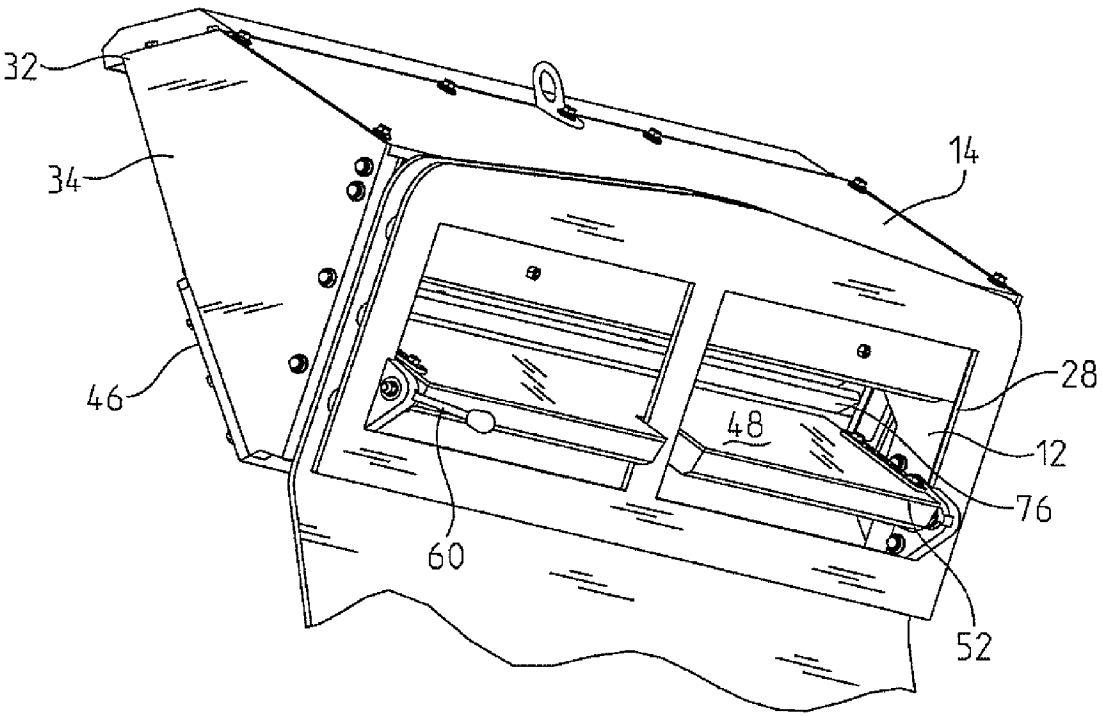
FIG. 3 is a perspective view of the window cover shown in FIG. 2 showing the opposite side as that shown in FIG. 2.

The present invention is a vehicle window 10 cover useful for military or other vehicles that are likely to be the target of bullets or projectiles. A vehicle with the cover 10 of this invention installed in the location where a front window would be located is shown in FIG. 1. Instead of a window, there is a window aperture 12 located where the window would be located. The window cover has an upper armored plate 14 having a top side 16, an underside 18, a forward end 20 and a rearward end 22. The forward end 20 being farther from the window aperture 12 than the rearward end 22. The upper armored plate 14 is angled upward so the forward end 20 is higher than the rearward end 22. The upper armored plate 14 extends beyond an upper edge 28 of the window aperture 12. FIG. 3 shows the viewing aperture and that parts of the window cover 10 extend beyond the viewing aperture 28. An economical installation of the window cover 10 does not require a window to be located behind or within the viewing aperture 12, thus saving the weight and cost associated with a window. The upper armored plate 14 is typically made of a steel plate thick enough to withstand bullets striking it and it is the top of an enclosure 32 capped by ends 34. The ends 34 are steel resistant to penetration by bullets.

Figure 5:
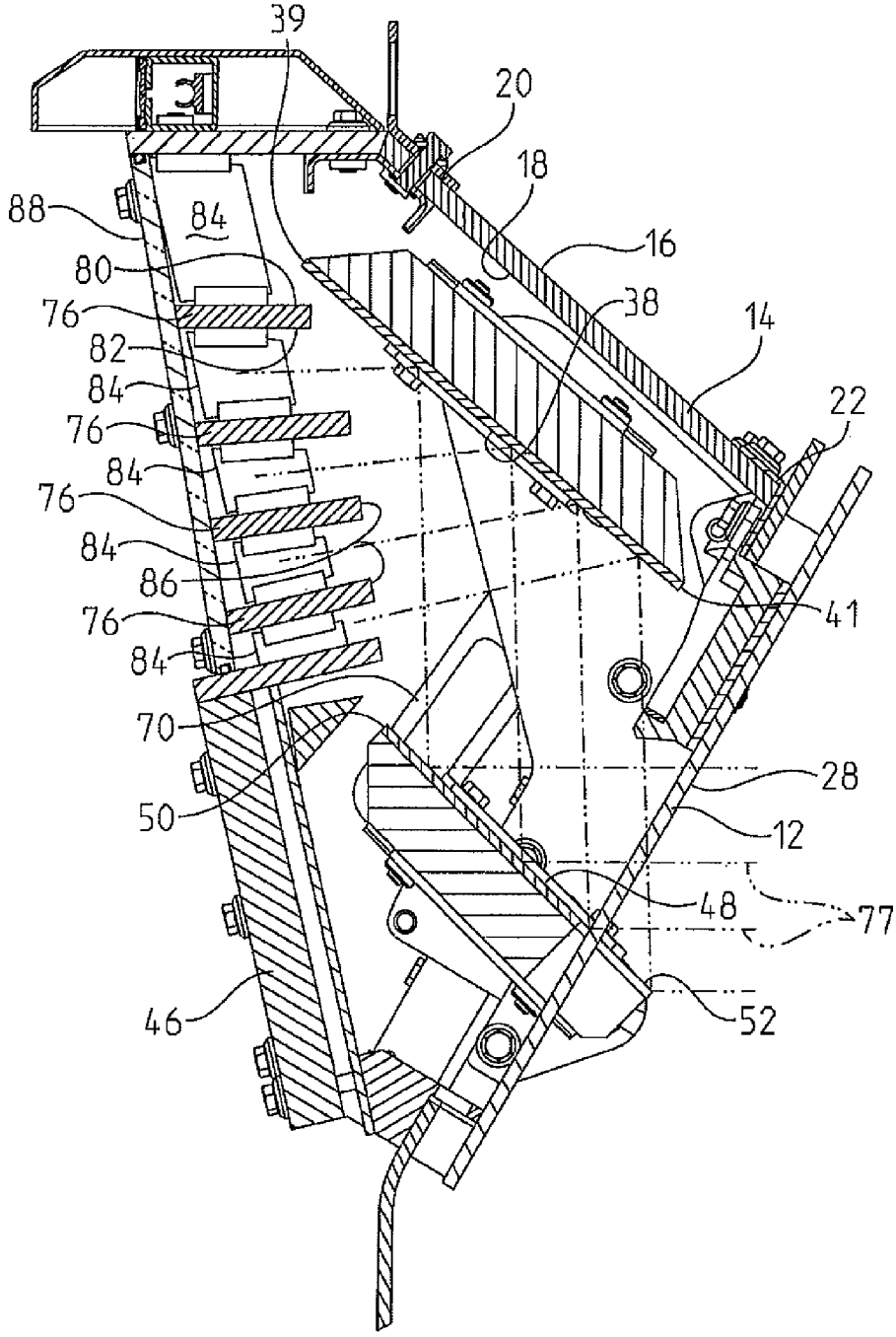
FIG. 5 is a sectional view taken about the line 5-5 in FIG. 4.
Figure 6:
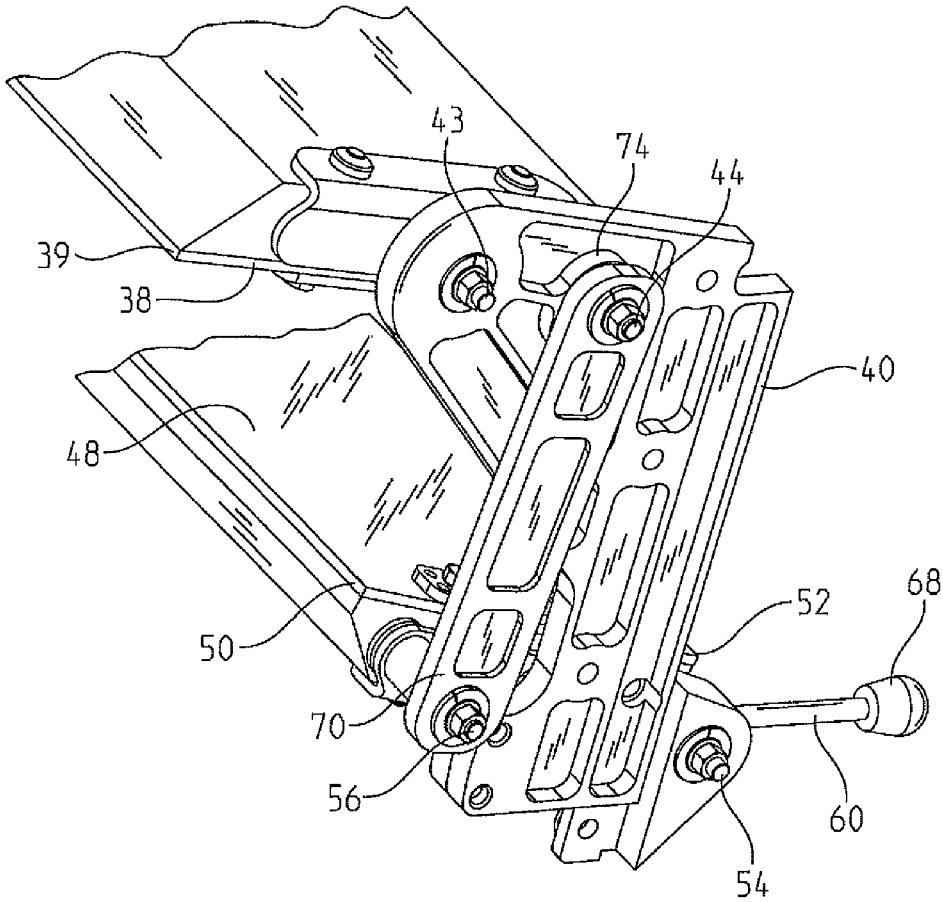
FIG. 6 is a perspective view showing the upper and lower reflectors in their mounting bracket.
Figure 7:
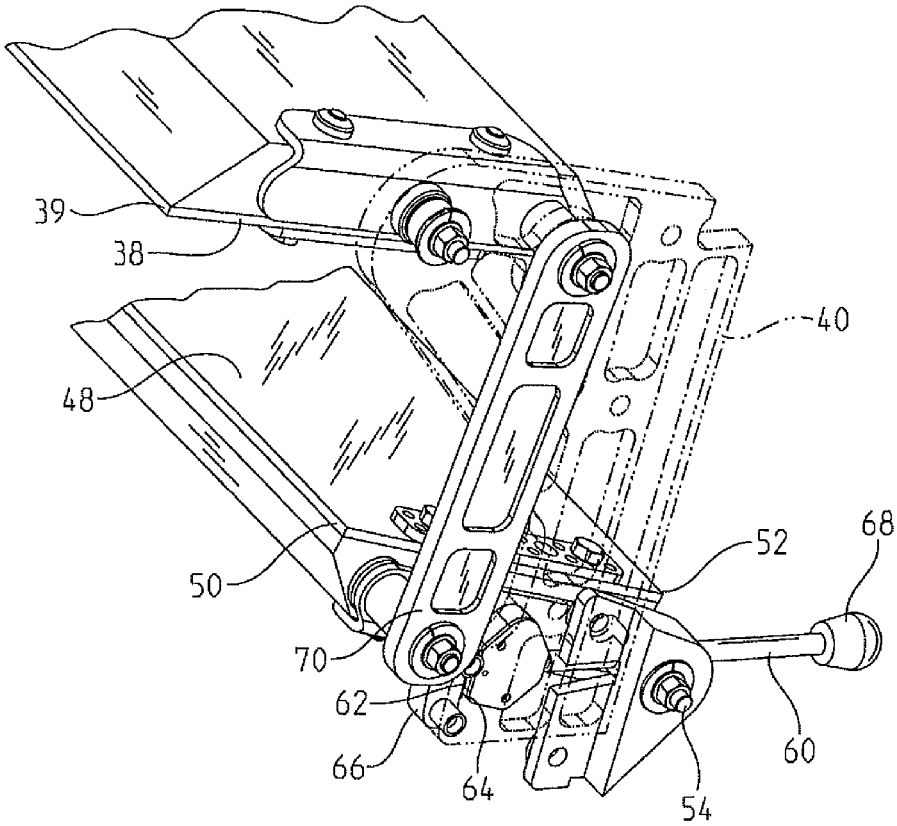
FIG. 7 is another perspective view of the upper and lower reflectors in their mounting bracket, with the mounting bracket shown in phantom.
Figure 8:
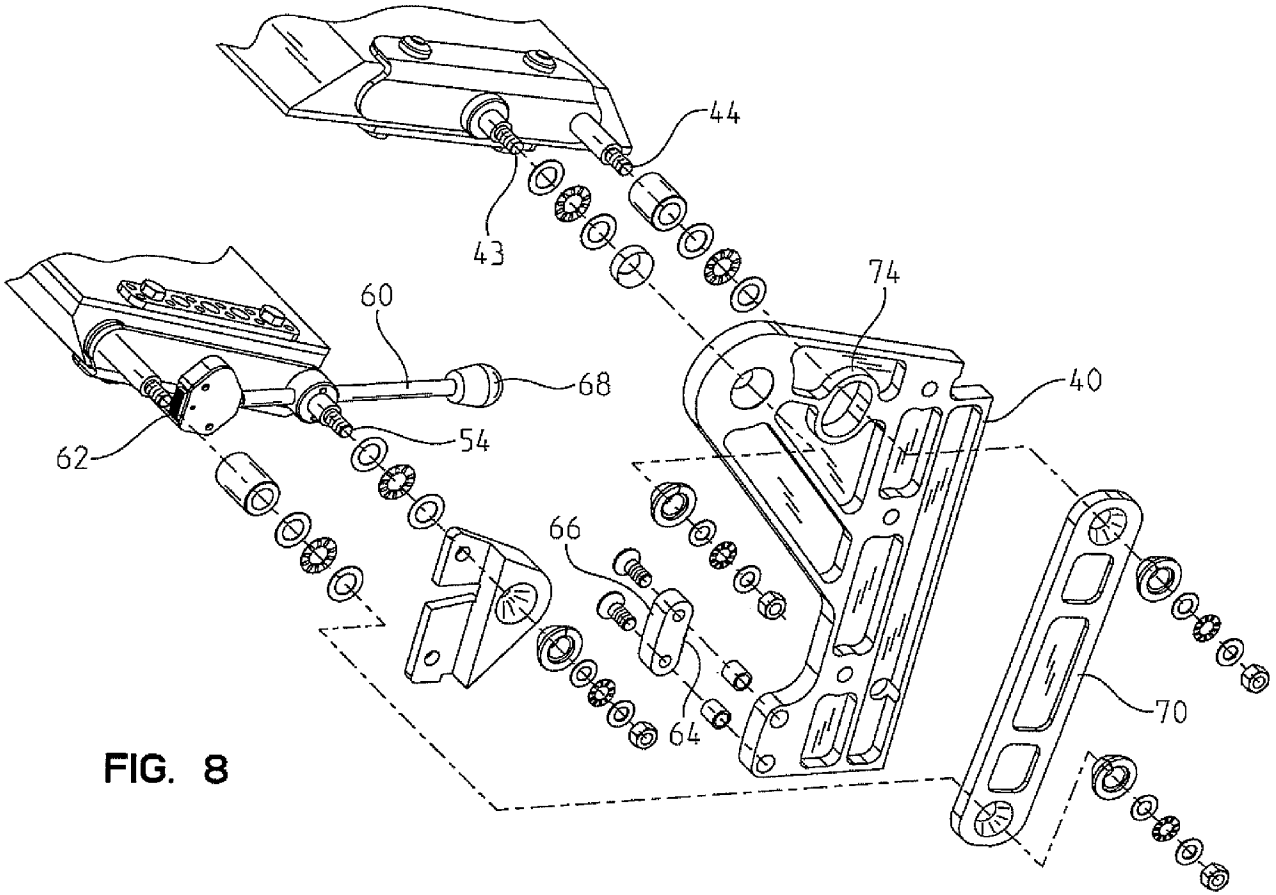
FIG. 8 is an exploded perspective view of the upper end lower reflectors and their mounting bracket.
Figure 9:
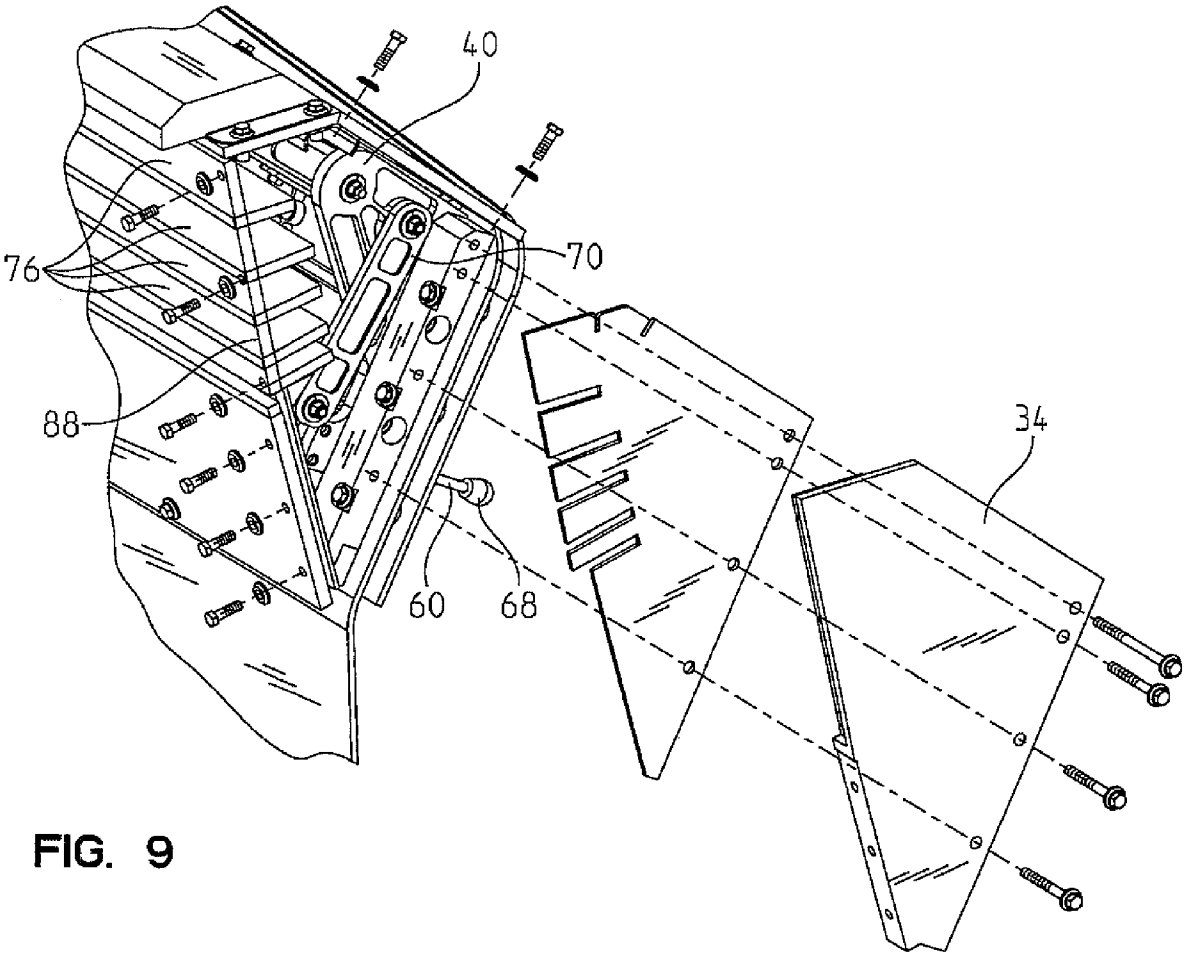
FIG. 9 is an exploded perspective view of the end of the enclosure removed.

An upper reflector 38 is just below the upper armored plate 14, as shown in FIG. 5. The upper reflector has a forward end 39 farther from the window aperture 12 and a rearward end 41 nearer the viewing aperture 12. The forward end 39 is higher than the rearward end. The upper reflector 38 can pivot relative to the fixed upper armored plate 14 and viewing aperture 12. FIG. 7 shows the mounting bracket 40 that is fixed within the enclosure 32 and holds the upper reflector 38. The upper reflector 38 pivots about the axis of pivot rod 43. Rod 43 is located near the middle of the upper reflector. A connector rod 44 is located between the rearward end 41 and pivot rod 40 on the upper reflector 38. The upper reflector 38 is made of a material penetrable by a projectile, but only leaves a hole the size of the projectile upon being punctured. This material may include a metal honeycomb structure behind a reflective surface.

Figure 4:
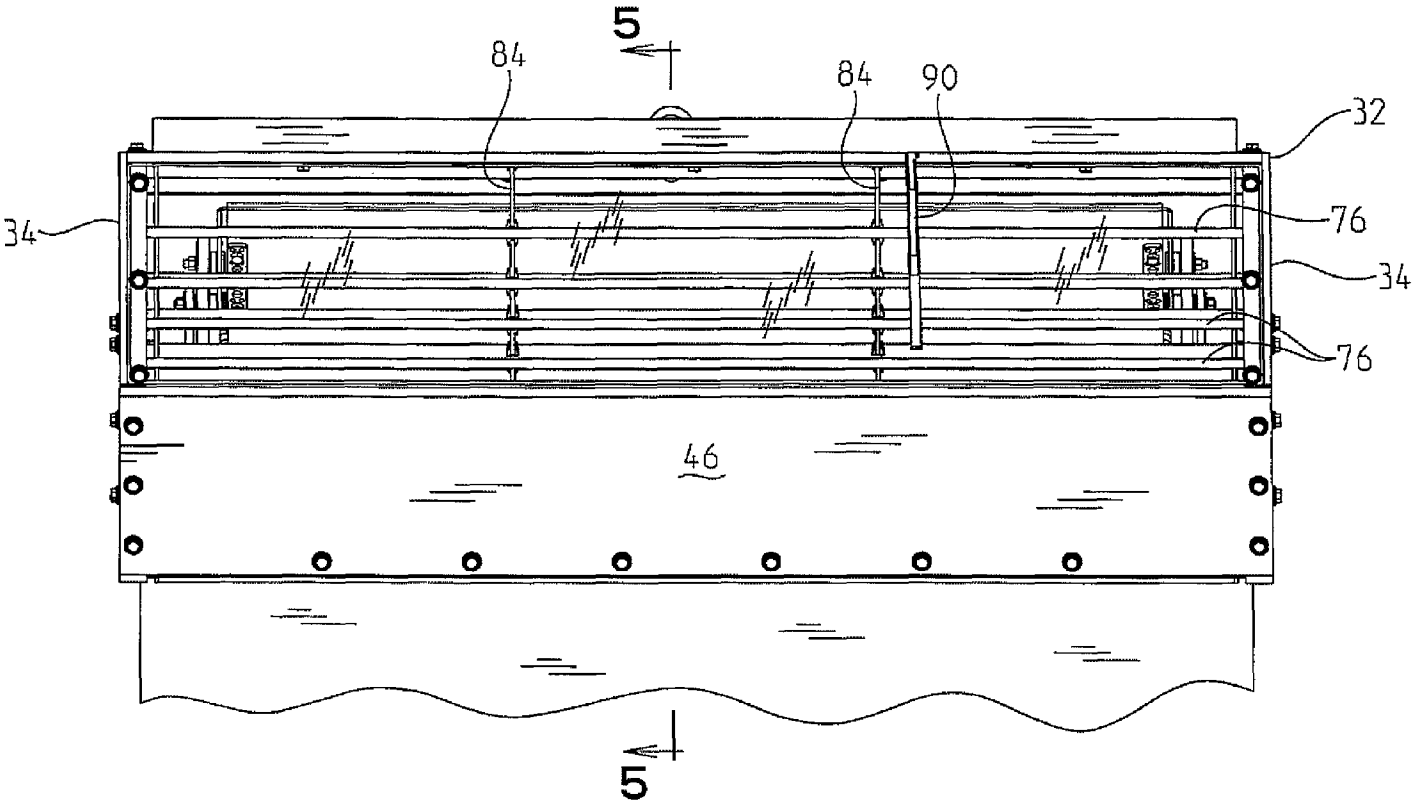
FIG. 4 is a front view of the window cover shown in FIG. 3.

A lower armored plate 46 is below the upper armored plate 14 and in front of the viewing aperture 12. As can be seen in FIG. 4, the lower armored plate 14 spans across the ends 34. Like the upper armored plate 14, the lower armored plate 46 is designed to stop or deflect bullets fired at the viewing aperture 12.

Behind the lower armored plate 46 is a lower reflector 48. The lower reflector has a forward end 50 farther from the viewing aperture 12 and a rearward end 52 nearer the viewing aperture 12. The forward end 50 is higher than the rearward end 52. The lower reflector 48 can pivot relative to the viewing aperture 12. The lower reflector 48 is mounted on pivot rod 54 near its rearward end 52. A connecting rod 56 is located near the forward end 50. A control rod 60 passes through pivot rod 54 and moves with the lower reflector 48. The control rod 60 is spring loaded so that it is urged toward the forward end 50 of the lower reflector 48. The end of the control rod 60 has teeth 62 that are designed to mate with teeth 64 on a stop block 66. The stop block 66 is mounted to the mounting bracket 40. When the handle 68 of the control rod 60 is pulled toward the interior of the vehicle, the teeth 62, 64 are disengaged as the teeth 62 on the control rod 60 are pulled away from the teeth 64 on the stop block 66. The control rod 60 is spring loaded where it passes through pivot rod 54 so that the teeth 62 on the control rod are biased against the teeth 64 on the stop block 66 when the control rod 60 is released.

A linkage 70 is pivotally connected near it ends at the connector rod 44 of the upper reflector 38 and connector rod 56 of the lower reflector. The linkage 70 is assembled as shown in FIG. 7. As can be seen in FIG. 7, the linkage 70 is pivotally connected to the upper reflector 38 rearward pivotal axis of the main pivotal axis of the upper reflector 38 with respect to the window cover 10, the main pivotal axis of the upper reflector being the centerline of rod 43. The linkage 70 is connected forward of the main pivotal axis of the lower reflector 48 with respect to the window cover, the main pivotal axis of the lower reflector 48 being the center line of rod 54. As the lower reflector 48 moves, the linkage 70 will cause the upper reflector 38 to move a proportionate amount. When the handle 68 of the control rod 60 is released the teeth 62, 64 will be engaged and hold both reflectors 38, 48 in their respective positions. The control rod 60 may be used to pivot the reflectors 38, 48 between a shallowest angle of the reflectors 38, 48 with respect to horizontal and a steepest angle with respect to horizontal. The highest position of the control rod 60 corresponds to the shallowest angle with respect to horizontal, and the lowest position of the control rod 60 corresponds to the steepest angle with respect to horizontal. The highest and lowest position of the control rod 60 is limited by slot 74. As the linkage 70 moves the connector rod 44 it will be stopped on the sides of slot 74.

Armored slats 76 span the ends 34 of the enclosure 32. Each armored slat has an upper surface 80 a lower surface 82 a forward edge 84 and a rearward edge 86. The forward edge faces away from the upper reflector 38 and the rearward edge 86 is nearer the upper reflector. The thickness of the slats 76 is the distance between the upper and lower surfaces 80, 82. The slats are separated by brackets 84 that maintain a predetermined distance between the slats 76. The slats 76 are made of steel that is durable enough to deflect a projectile that may strike them. An outer window 88 is placed in front of all of the slats 76 to prevent debris from entering the enclosure 32. The slats 76 are positioned so that a projectile entering the outer window 88 would have a trajectory that would require it to pass through at least two slats 76 to enter the viewing aperture 28. The slats 76 are designed of a material that would typically prevent them from being penetrated by a projectile, but in the event that a projectile did pass through one of the slats 76, the second slat 76 within the trajectory would stop the projectile. A wiper 90 is included to clean the outer window 88. The window 88 is made from a material that, when punctured by a projectile, will leave a hole only the size of the projectile.

The angle of each slat 76, with respect to horizontal, is slightly different to make them appear optically as thin as possible to an occupant of the vehicle. The slats 76 are aligned so the rearward edge 86 obscures the forward edge 84 of each slat 76 and all that is visible is the thickness of each slat 76 when viewed from inside the vehicle. The slats 76 are aligned so that this happens when the control rod 60 is in between its highest position and its lowest position.

FIG. 5 shows lines of light 77 entering the window cover 10 and how they are reflected from the upper reflector 38 to the lower reflector 48. The configuration shown in FIG. 5 produces a view that contains four thin lines, one for each slat 76, across the field of view.

Figure 10:
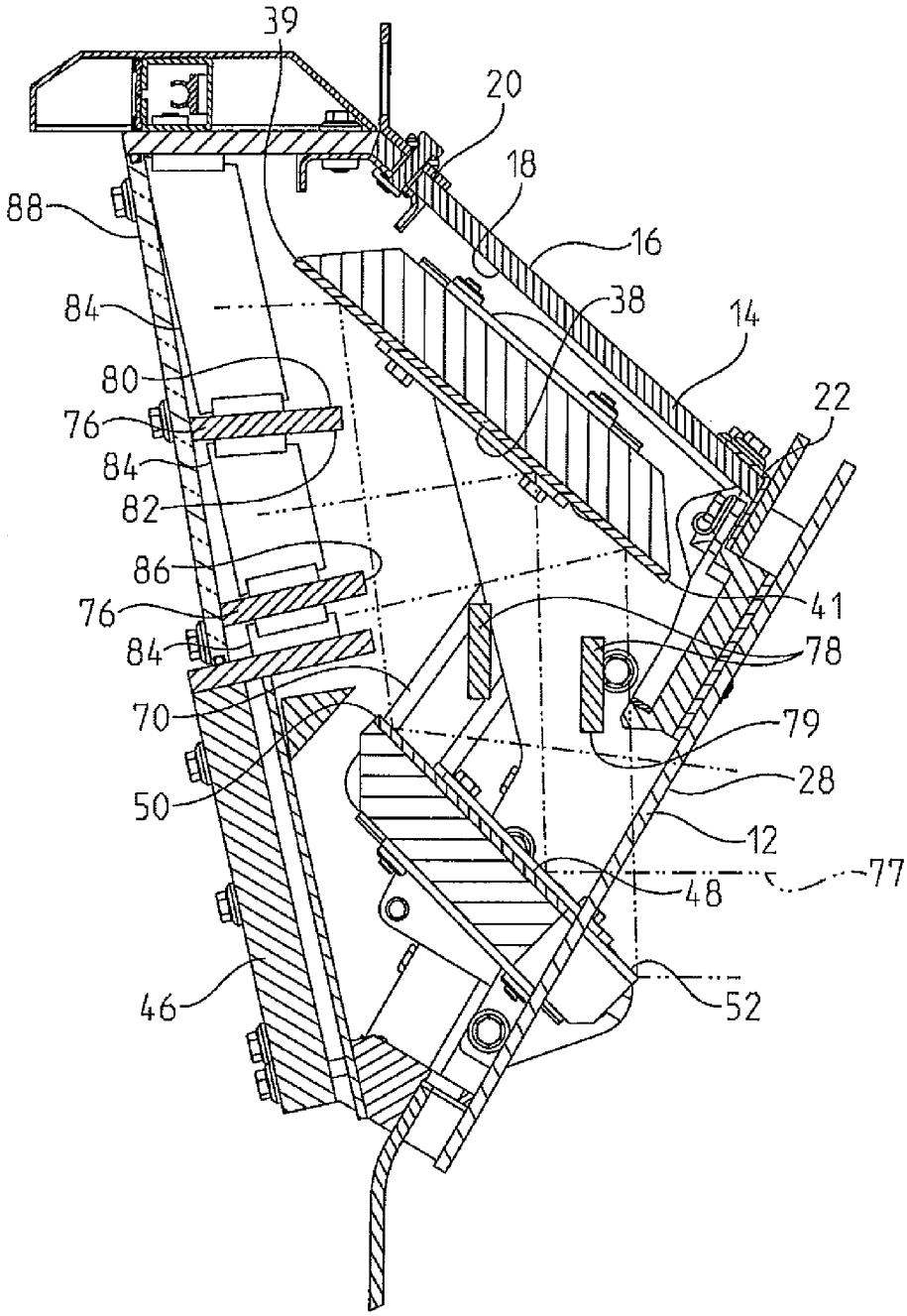
FIG. 10 is a sectional view of another embodiment of the window cover.

FIG. 10 shows a configuration similar to the one in FIG. 5. FIG. 5 shows a configuration having only horizontal slats 76. The configuration of FIG. 10 has only two horizontal slats 76. Vertical slats 78 are optically aligned with horizontal slats 76. In other words, the vertical slats 78 are placed so that each of their lowermost edges 79 obscure not only the vertical slat 78, but also obscures its corresponding horizontal slat 76. The placement of each vertical slat 78 is along the line light blocked from the horizontal slat 76. As such, only two lines appear across the field of view of an occupant of the vehicle using the configuration shown in FIG. 10.

An occupant of the vehicle, who is the user of the window cover 10, is protected from projectiles and may alter his view of objects in front of the vehicle without leaving the vehicle. As projectiles are fired at the vehicle from above, they will strike a slat and be prevented from passing through the viewing aperture 12. Projectiles fired at an angle, that would allow them to pass through the slats 76, would be prevented from reaching the viewing aperture because such a trajectory would be above the viewing aperture. The occupant can change the view by pulling the control rod 60 toward himself to disengage the teeth 62, 64, moving the upper and lower reflectors 38, 48 through use of the control rod 60 and then releasing the rod 60 so that the teeth 62, 64 maintain the desired position of the reflectors 38, 48. The fact that both reflectors 38, 48 are linked means that smaller reflectors can be used to change the view and also means that less movement of the control rod 60 is needed than if just one of the reflectors moved.

The invention is not limited to the details given above, but may be modified within the scope of the following claims.

What is claimed is:

1. A window cover for a vehicle having a window aperture located in place of a window, said cover comprising:

an upper armored plate having a top side, an underside, a forward end and a rearward end, said forward end of said upper armored plate being farther from said window aperture relative to said rearward end, with the underside at least partially extending beyond an upper edge of said viewing aperture;

an upper reflector beneath said underside of said upper armored plate and pivotable with respect to said viewing aperture and said upper reflector pivotable with respect to said upper armored plate, said upper reflector having a forward end and a rearward end, said forward end of said upper reflector being farther from said window aperture relative to said rearward end of said upper reflector, said forward end of said upper reflector being higher than said rearward end of said upper reflector;

a lower armored plate spaced below said upper armored plate, positioned in front of said viewing aperture, said lower armored plate constituting means for stopping or deflecting a projectile; and a lower reflector having a forward end and a rearward end, said forward end of said lower reflector being further from said window aperture relative to said rearward end of said lower reflector, said forward end of said lower reflector being higher than said rearward end of said lower reflector, said lower reflector being pivotable with respect to said viewing aperture and said lower reflector being pivotable with respect to said lower armored plate, said lower reflector being positioned beneath said upper reflector so that light reflected from said upper reflector strikes said lower reflector, said lower reflector being behind said lower armored plate, said lower reflector being connected to said upper reflector with a linkage so that pivoting said lower reflector causes said upper reflector to pivot.

2. A window cover as claimed in claim 1, wherein said linkage is pivotally connected to said upper reflector rearward of a main pivotal axis of said upper reflector, and said linkage is pivotally connected to said lower reflector forward of a main pivotal axis of said lower reflector.

3. A window cover as claimed in claim 1, wherein said forward end of said upper armored plate is higher than said rearward end of said upper armored plate.

4. A window cover as claimed in claim 2, wherein slats having upper and lower surfaces defining a thickness and said slats having forward and rearward lateral edges defining a width are positioned in front of said upper reflector so that light entering said window cover passes between said upper and said lower surfaces adjacent to said slats to strike said upper reflector.

5. A window cover as claimed in claim 4, wherein said slats are positioned such that said rearward edges obscure said forward edges in at least one predetermined position of said reflectors when viewed behind said lower reflector.

6. A window cover as claimed in claim 5, further comprising vertical slats positioned above said lower reflector, said vertical slats being positioned so that lower edges of said vertical slats obscure said vertical slats, and said lower edges of said vertical slats obscure said slats positioned in front of said upper reflector.

7. A window cover as claimed in claim 2, wherein said upper reflector is penetrable by a projectile fired from in front of said vehicle toward said window cover.

8. A window cover for a vehicle having a window aperture located in place of a window, said cover comprising:

an upper armored plate having a top side, an underside, a forward end and a rearward end, said forward end of said upper armored plate being farther from said window aperture relative to said rearward end, said forward end being higher than said rearward end with the underside at least partially extending beyond an upper edge of said viewing aperture;

an upper reflector beneath said underside of said upper armored plate and pivotable with respect to said viewing aperture and said upper reflector pivotable with respect to said upper armored plate, said upper reflector having a forward end and a rearward end, said forward end of said upper reflector being farther from said window aperture relative to said rearward end, said forward end of said upper reflector being higher than said rearward end of said upper reflector;

a lower armored plate spaced below said upper armored plate, positioned in front of said viewing aperture, said lower armored plate constituting means for stopping or deflecting a projectile; and a lower reflector having a forward end and a rearward end, said forward end of said lower reflector being further from said window aperture relative to said rearward end of said lower reflector, said forward end of said lower reflector being higher than said rearward end of said lower reflector, said lower reflector being pivotable with respect to said viewing aperture and said lower reflector being pivotable with respect to said lower armored plate, said lower reflector being positioned beneath said upper reflector so that light reflected from said upper reflector strikes said lower reflector, said lower reflector being behind said lower armored plate, said lower reflector being connected to said upper reflector with a linkage so that pivoting said lower reflector causes said upper reflector to pivot.

9. A window cover as claimed in claim 8, wherein slats having upper and lower surfaces defining a thickness and said slats having forward and rearward lateral edges defining a width are positioned in front of said upper reflector so that light entering said window cover passes between said upper and said lower surfaces adjacent to said slats to strike said upper reflector.

10. A window cover as claimed in claim 8, wherein said slats are positioned such that said rearward edge obscures said forward edge in at least one predetermined position of said reflectors when viewed behind said lower reflector.

11. A window cover as claimed in claim 8, wherein said upper reflector is penetrable by a projectile fired from in front of said vehicle toward said window cover.

12. A window cover as claimed in 10, further comprising vertical slats positioned above said lower reflector, said vertical slats being positioned so that lower edges of said vertical slats obscure said vertical slats, and said lower edges of said vertical slats obscure said slats positioned in front of said upper reflector.

13. A window cover as claimed in claim 10, wherein said linkage is pivotally connected to said upper reflector rearward of a main pivotal axis of said upper reflector, and said linkage is pivotally connected to said lower reflector forward of a main pivotal axis of said lower reflector.

* * * * *